US005417473A

United States Patent [19]

Bräuning

[11] Patent Number: 5,417,473

[45] Date of Patent: May 23, 1995

[54] CHAIR MECHANISM PROVIDING FOR AN INCLINATION RANGE AND INCLINATION STOP MEANS

[75] Inventor: Egon Bräuning, Weil am Rhein, Germany

[73] Assignee: Protoned B.V., Amsterdam, Netherlands

[21] Appl. No.: 129,599

[22] Filed: Sep. 30, 1993

[30] Foreign Application Priority Data

Oct. 8, 1992 [CH] Switzerland ..... 03145/92

[51] Int. Cl.[6] ..... A47C 3/00

[52] U.S. Cl. ..... 297/302; 297/303

[58] Field of Search ..... 297/300, 301, 302, 303

[56] References Cited

U.S. PATENT DOCUMENTS

| | | | |
|---|---|---|---|
| 3,740,792 | 6/1973 | Werner . | |
| 4,773,706 | 9/1988 | Hinrichs | 297/300 |
| 4,986,601 | 1/1991 | Inoue . | |
| 5,195,801 | 6/1993 | Franck et al. | 297/300 |

FOREIGN PATENT DOCUMENTS

| | | |
|---|---|---|
| 3735256 | 5/1983 | Germany . |
| 8133573 | 5/1983 | Germany . |
| 3916474 | 11/1990 | Germany . |
| 629945 | 5/1982 | Switzerland . |
| 647665 | 2/1985 | Switzerland . |
| 650136 | 7/1985 | Switzerland . |
| 9203072 | 5/1992 | WIPO . |

*Primary Examiner*—Richard A. Bertsch
*Assistant Examiner*—Roland G. McAndrews, Jr.
*Attorney, Agent, or Firm*—Ralph W. Selitto, Jr.

[57] ABSTRACT

A chair mechanism (1) for office chairs comprises a synchronous mechanism with integrated negative inclination. The aim is to achieve all sitting postures occurring during office work, and in particular the correction of injurious continuous sitting. The arrangement, the function and the connection of the pivot axes and the configuration of the seat support (4) within the chair mechanism (1) have predominant novelty value. Mechanical springs, which are less expensive than gas springs, are used as component parts. Springing during synchronous movement is effected by means of a torsion spring (9), while the negative inclination utilizes compression springs (21). The mechanism offers a number of options—locking in determined functions—for special applications. In addition to the wide movement range, the apparatus is distinguished by a compact and efficient construction.

8 Claims, 5 Drawing Sheets

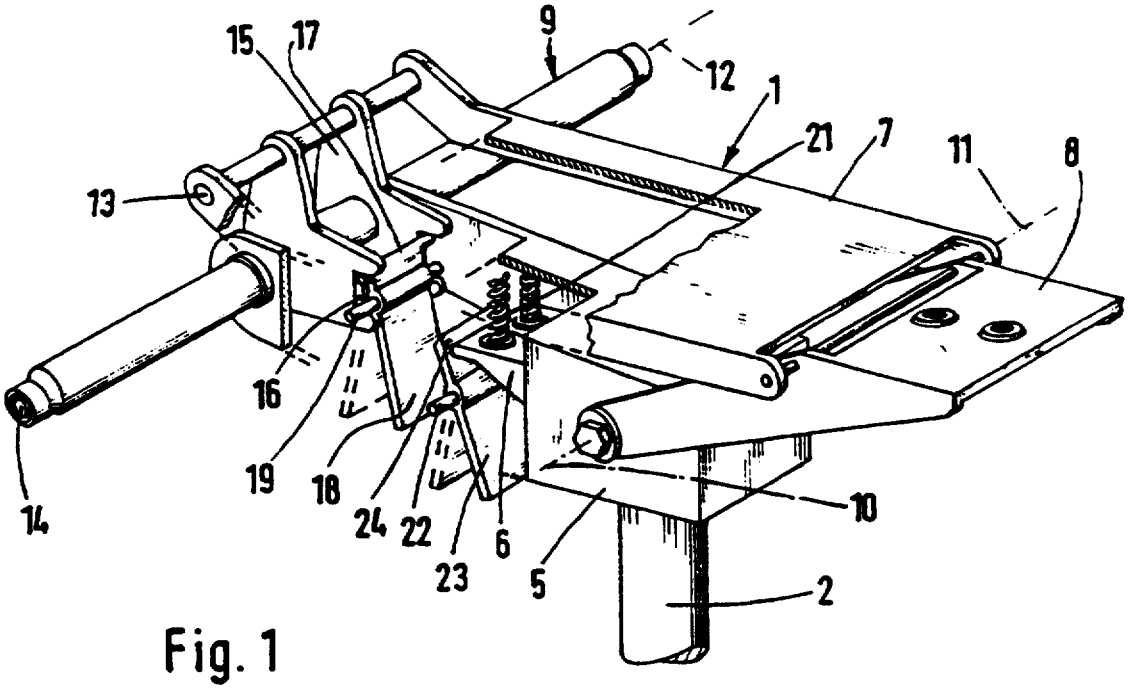
Fig. 1
Fig. 2
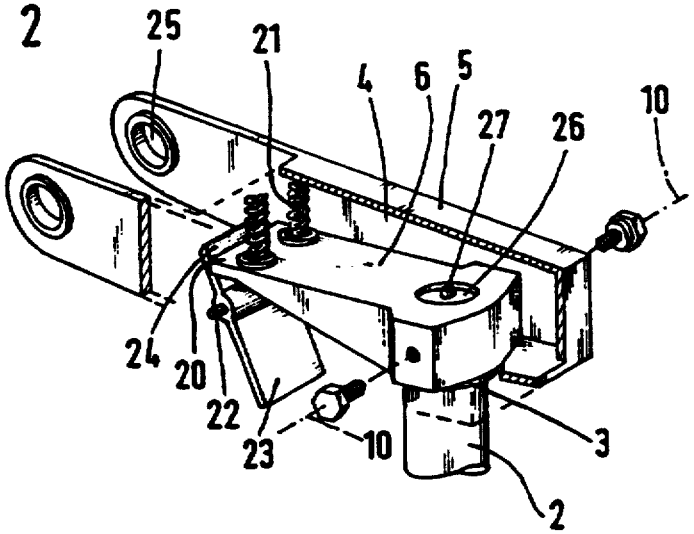

CHAIR MECHANISM PROVIDING FOR AN INCLINATION RANGE AND INCLINATION STOP MEANS

BACKGROUND OF THE INVENTION

The invention relates to a chair mechanism for work chairs, particularly office swivel chairs, with synchronously adjustable inclination of the back rest and seat.

People employed in offices spend the major part of their working hours in a sitting position. It is taken as an established fact that the poor sitting position often adopted by them makes a considerable contribution to back injuries. A writing position, leaning forward, for hours at a time leads in particular to a considerable strain on the skeleton, as well as on the muscles and tissues of the back, and even to permanent curvature of the spine, the so-called hunchback (kyphosis).

This has given rise to many attempts to improve the geometry and the adaptability of chairs to different conditions of use with a view to healthier sitting. It has been found that frequent—even if only brief—relief of the human back by leaning back or leaning in a relaxed position already substantially reduces the strain on the back.

The construction of conventional office chairs, which apart from the swivellability was otherwise largely rigid, was scarcely suitable for effectively supporting the user's back. It is at best only in the upright position that such back rests in chairs of this kind have a positive action. A first improvement was made by Swiss Patent Specification 647 665, in which a back rest divided horizontally into two and comprising a fixed bottom part and a top part mounted resiliently thereabove was proposed. The construction enabled the user to lean backwards in a somewhat relaxed manner. An actual relaxing position was not however achievable, because, although the back rest partly adapted to the conditions of use at a given moment, nevertheless the seat surface did not harmoniously follow this adaptation but was mounted in a fixed position or could only be moved forwards and backwards.

Frame structures for office chairs were then further improved by enabling the seat to follow synchronously, by means of lever and joint connections, the adjustment of the back rest, so that ergonomically adapted positioning of the seat surface was associated with each inclination of the back rest. Synchronous mechanisms of this kind may be found in U.S. Pat. No. 4,773,703 or in U.S. Pat. No. 5,195,801; modifications are for example described in Swiss Patent Specification 629 945 and in German Offenlegungsschrift 37 35 256. These mechanisms enable the user to shift from the upright working posture into a backwardly inclined relaxing position, for example for a lengthy telephone conversation, by simply leaning the weight of the body backwards against the back rest, which usually has a damped spring action. In this movement the seat follows the inclining back rest in the same direction so that the user, after a lengthy upright or forwardly inclined sitting posture, assumes a position of rest which relieves his back and hip parts. With the aid of chairs having this type of configuration, which permit easy and frequent changes to a relaxing position for the user, it was possible to improve sitting comfort.

As a rule, however, office work is not done in an upright or relaxed backward leaning position, but in a posture ranging from a forwardly inclined to a hunched position in order to be in the closest possible contact, depending on eyesight, with the business papers lying on the desk. For the purposes of protracted desk work the chair constructions mentioned are of course only a partial improvement as regards a healthier sitting position, because the user can only very seldom adopt an upright or backwardly inclined posture, but on the contrary must predominantly retain a forwardly inclined sitting position. In this sitting position the front portion of the chair seat presses against the underside of the thighs, and the back rest does not effectively support the user's back part, while moreover the user also has no incentive to abandon the hunched posture.

After this had been realized, attempts were made also to alleviate in other ways the detrimental consequences of continuous sitting. Mechanisms were then proposed with the aid of which the seat surface was lowered in the forward direction (negative inclination) as the result of the shift of weight when the user adopted a forwardly inclined writing position. The user was thus induced to straighten his spine.

An apparatus of this kind is described in German Utility Model 81 33 573 for use as a typist's chair. A rocker is proposed therein which, through alternative installation of the operating lever from two different sides, is suitable in the one variant for a typist's chair which can be forwardly inclined from the normal vertical position, and in the other variant for an executive chair inclinable in the rearward direction from the normal position. This apparatus has the disadvantage that not all chair adjustments or movement cycles typical of an office can be achieved with it. In the one case only the normal position and the negative inclination, and in the other case the normal position and the relaxing position are possible.

Finally, an extreme form of chair with negative inclination and without a back rest came on the market. The user adopts a kneeling attitude in this chair, and the legs have to be bent backwards. His knees and shins rest on a support disposed at a height about halfway between the seat surface and the floor. Because of the obligatory squatting position, this construction is not very suitable for practical requirements in an office.

According to Swiss Patent Specification 650 136 another mechanism for an office chair having a lockable negative inclination is known. In order to give the user of this chair at least to a slight extent the ability to lean back, the back rest was divided horizontally into two and the top part of the back rest was resiliently mounted on the bottom part of the latter. The construction proposed here is very expensive, because two separate movement mechanisms—under the seat and in the back rest—are required. Furthermore, this chair also does not enable all sitting postures to be assumed or all movement cycles to be carried out.

There are thus now two directions for attempts to counter the harmful sitting posture in a continuous writing position—with the danger of curvature of the spine—by the constructional configuration of office chairs.

On the one hand the direction taken was the development of synchronous mechanisms to allow the user frequent short relaxation periods in a backwardly inclined relaxing position. At the same time it was attempted to prevent the backward rolling of the pelvis, resulting in a curved back, by means of a back rest configuration with lumbar support, often combined with the raising of the rear seat surface. The supporting action of the back rest is however attained only when the user is completely seated in the chair and makes firm contact with the back rest. In reality, however, most office workers do not sit completely in the chair, but sit further forward on the seat, and thus are given no support for their backs.

On the other hand, predominantly in Scandinavia, the direction taken was the development of mechanisms allowing a negative inclination for the writing posture of the user. The forwardly inclining seat surface is followed by the opposite reaction of the user's pelvis and thus by a forwardly inclined but nevertheless straight posture of the entire upper part of the body.

The generations of chairs produced to date provide only a partial solution to the problems of continuous sitting. Modern synchronous mechanisms are advantageous for users whose work permits frequent changes of posture. This relates, for example, to upright sitting during business discussions, a forwardly bent position for dealing with documents, and a relaxed posture during lengthy telephone conversations and intensive reflection. However, employees engaged mainly in desk work, that is to say in a forwardly inclined position, can make only little use of the advantages resulting from synchronous mechanisms. Such designs moreover are not ideal for rising from the chair. The user has to swing himself out of an unfavourable normal position—sitting completely in the chair in an upright attitude—with much effort and support by the arms. The other direction, in which the otherwise typical bad sitting position is corrected by a forwardly (negatively) inclined seat surface, soon leads to symptoms of fatigue through sitting on an inclined surface.

The springs used are of fundamental importance to the functioning of the mechanisms. To achieve the synchronous movement, widespread use is made of gas compression springs, which in some cases are also coupled to coil compression springs in order to optimize the movement cycle for the adjustment of the chair (see German Offenlegungsschrift 39 16 474, Swiss Patent Specification 629 945). The use of gas compression springs is however disadvantageous in many respects. Firstly, they are relatively expensive, thus affecting the cost of the entire chair. In addition, gas compression springs must be coupled to mechanical springs in order to achieve an advantageous movement cycle. This leads to further expense and the complication of the whole structure. Furthermore, because the seals are subject to wear, gas compression springs have only a limited useful life. A recent proposal was therefore to use a specially-shaped torsion spring (see International Publication WO 92/03072) for the spring system for the synchronous movement, as a mechanical solution free from problems.

Taking as starting point the previous short-comings of existing chair mechanisms and positive attempts to provide solutions, the problem underlying the invention is that of providing a mechanism which combines the advantageous tendency towards the straightening of the upper part of the human body through negative inclination of the seat surface, with the utilization possibilities offered by a synchronous mechanism. All sitting postures for the work to be done in an office should be achievable steplessly and continuously, in a manner imposing no strain on the hips and spine, with automatic adaptation solely through a change of posture or a shift of the weight of the upper part of the body, without support or lifting of the buttocks. The apparatus should be serviceable for the body weight range from about 45 kilograms to about 120 kilograms, and should offer special options, for example for persons whose body weights are very light or who have spinal problems. In addition, the apparatus must be produced with a compact construction in the interests of aesthetic configuration of the entire chair. Finally, the design and the components used must permit efficient and economical series production.

SUMMARY OF THE INVENTION

The chair mechanism comprises a seat support and a back rest carrier which are mounted for swivelling in the same direction and in dependence on one another. The seat support is pivoted at a rear portion, on a pivot axis for the seat and back rest carriers, to the back rest carrier, and at a front portion on a front seat pivot axis. The lastnamed is connected to the synchronous movement main pivot axis, which constitutes the longitudinal axis of a torsion spring, by driver plates fastened to the front seat pivot axis and to the torsion spring. A stop is provided in a recess of the driver plates in order to limit the swivelling range.

Essential is that the swivelling range of the synchronous movement between the seat carrier and the back rest carrier is preceded by a negative inclination range, as inclination of the chair mechanism in forward direction, about a negative inclination pivot axis. Depending on the sitting posture of the user and the distribution of his body weight, the user is provided with a chair swivelling range with stepless transitions from a forwardly inclined position to a rearwardly inclined position. This swivelling range is made possible by the fact that the connected functional elements of the synchronous mechanism, i.e. seat carrier, driver plates, torsion spring and back rest carrier, are mounted as a system on the negative inclination pivot axis which is situated in line with an upright tube and, as such, are pivotable about this pivot axis on a resilient seat support.

THE DRAWINGS

One example of embodiment of the synchronous mechanism according to the invention, with integrated negative inclination, is described below with reference to the accompanying drawings, in which:

FIG. 1 shows a chair mechanism (cut open);

FIG. 2 shows a seat support (cut open);

DETAILED DESCRIPTION OF THE DRAWINGS

Figure 3:
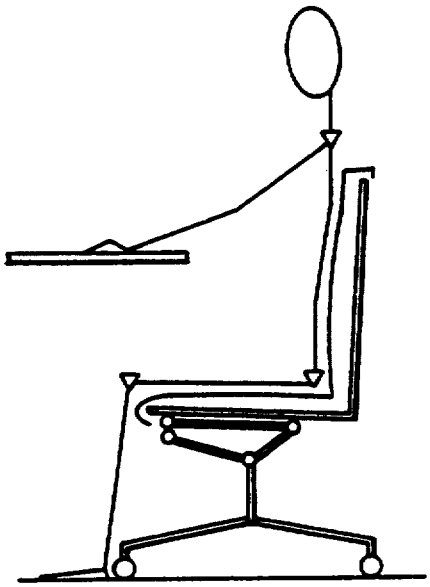
FIG. 3 shows a chair in the upright position (normal position: seat surface horizontal, back rest vertical)

The basic construction will first be explained with the aid of FIGS. 1 and 2. The chair mechanism 1 is mounted as a whole on the upright tube 2 of the chair frame, said upright tube 2 being seated in a holding cone 3 of the chair mechanism 1. The chair mechanism 1 consists of the seat support 4—which is composed of a movable seat support part 5 and a fixed seat support part 6 (for example of cast iron)—and of the seat carrier 7, the back rest carrier 8 and the torsion spring 9. The back rest carrier 8 is pivoted on the one hand on the negative inclination pivot axis 10 and on the other hand on the pivot axis 11 for the seat and back rest carriers. The negative inclination pivot axis 10 extends horizontally and centrally through the holding cone 3. The negative inclination pivot axis 10 and the pivot axis 11 for the seat and back rest carriers lie parallel to one another; the torsion spring 9—its centre axis being at the same time the main axis of rotation 12 for the synchronous movement—and the front seat pivot axis 13 likewise extend parallel thereto. The seat carrier 7 is on the one hand articulated to the back rest carrier 8 on the pivot axis 11 for the seat and back rest carriers, and on the other hand is pivoted on the front seat pivot axis 13.

Between the front seat pivot axis 13 and the torsion spring 9—together with the torsion bar 14 contained in it—are disposed two driver plates 15 which lie parallel and are spaced apart and which connect said pivot axis and said torsion spring. The driver plates 15 have approximately the shape of a sheet metal angle, through the upwardly extending legs of which the seat pivot axis 13 passes, while the torsion spring 9 passes through their corners. For the transmission of an adjusting movement to the torsion spring 9 the connections between the latter and the driver plates 15 and also the connections between the driver plates 15 and the front seat pivot axis 13 are rigid (for example made by welding). The second legs of the driver plates 15 are directed horizontally into the chair mechanism 1. On the end of each of these legs of the plate a recess 16 is formed, into which the beak 17 of a catch lever 18 for the synchronous movement can be swivelled. The catch lever 18 is mounted on the catch lever pin 19. Between the tongue portion 20 of the fixed seat support part 6 and the movable seat support part 5 situated thereabove a pair of coil compression springs 21 is disposed. Under the tongue portion 20 a locking lever 23 provided with a locking beak 24 is swivellably mounted on a locking lever pin 22. The movable seat support part 5 is mounted on the one hand—like the back rest carrier 8—on the negative inclination pivot axis 10 and on the other hand is rigidly connected to the torsion spring 9 passing through the receiving bores 25. It is also possible for the seat support 4 to be in the form of a one-piece resilient component consisting of a leaf spring or of an elastic member of plastics material, in which case the locking lever 23 must then act on this one-piece seat support 4.

In line with the upright tube 2 and with the holding cone 3, a bore 26 smaller than the latter extends through the fixed seat support part 6. The operating rod 27 for the gas compression spring (not shown) for adjusting the height of the seat projects out of the bore 26.

With the aid of the following figures the synchronous mechanism with the integrated negative inclination will now be described in the different functional positions.

In these figures the various lines have the following meanings:

| | |
|---|---|
| Solid line | the instantaneous adjusted position; |
| Dash-dot-dash line | the "O" position (no displacement; |
| Dashed line | the possible displacement(s) |

Figure 4:
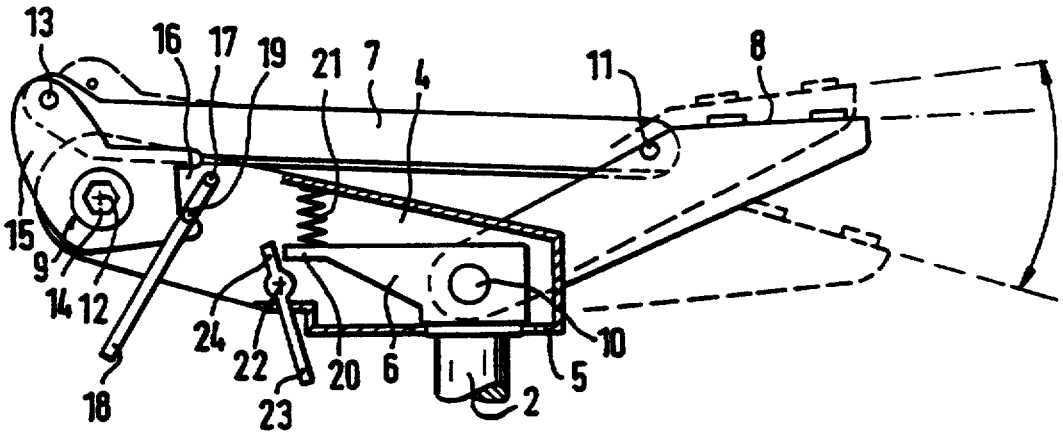
FIG. 4 shows a chair mechanism in the upright position.

FIG. 3 shows the chair in the normal position. The user seated on it has an upright posture, as for example for a conversation or the sorting of papers. FIG. 4 is the corresponding configuration of the chair mechanism 1. The seat cushion on the seat carrier 7 extends practically horizontally; the back rest mounted on the back rest carrier 8 extends at right angles to said seat cushion.

The torsion spring 9 and the compression springs 21 are loaded beyond their initial stress. The catch lever 18 for the synchronous movement is not swivelled in; the catch lever beak 17 is not in engagement with the recess 16 in the plate and the catch lever pivot pin 19 lies against the bottom lug of the recess 16 in the plate. The catch lever 18 could however also be swivelled in in this normal position (in this connection see the explanation relating to FIGS. 9 and 11).

In this normal position the synchronous mechanism remains out of action. The user applies the weight of his body in the upright sitting position centrally to the chair such that the back rest is not moved out of the "O" position. The occupant of the chair does not press his back against the back rest and the force acting on the back rest carrier 8 through the body weight loading the pivot axis 11 for the seat and back rest carriers is balanced by-the initial stress of the torsion spring 9. The main pivot axis 12 for the synchronous movement, the front seat pivot axis 13, the pivot axis 11 for the seat and back rest carriers, and the back rest carrier 8 additionally pivoted on the negative inclination pivot axis 10 are not turned.

The distribution of the body weight applied to the chair in the upright position of use also does not give rise to the actuation of the negative inclination in the form of a forward swivelling of the chair mechanism 1 about the negative inclination pivot axis 10, relative to the fixed seat part 6. The normal loading of the seat carrier 7 is balanced by the initial stress of the compression springs 21; in addition, the load acting on the front part of the seat is reduced by the fact that the user takes some of the weight through his feet supported on the floor. The distance, in the region of the compression springs 21, between the tongue portion 20 of the fixed seat part 6 and the inclined arm, lying above it, of the movable seat support part 5 is at its maximum. On the other hand, the distance between the tongue portion 20 and the offset arm, lying below it, of the movable seat support part 5 is minimal, so that the locking lever 23 for the negative inclination cannot be swivelled in, with its locking beak 24 under the tongue portion 20. In the event of the actuation of the negative inclination, the movable seat support part 5 makes a downward swivelling movement in the region of the compression spring 21 and of the locking lever axis 22 lying therebeneath. Since the locking lever axis 22 is fastened to the movable seat support part 5, the increasing distance would finally allow the locking lever 23 to be swivelled in. On a change of posture or a weight displacement by the user, the chair mechanism 1 could, depending on the direction of the load, be inclined, without transition, from the normal position—with the catch lever 18 not swivelled in—forwards in the direction of the negative inclination or rearwards in the direction of the relaxing position.

Figure 5:
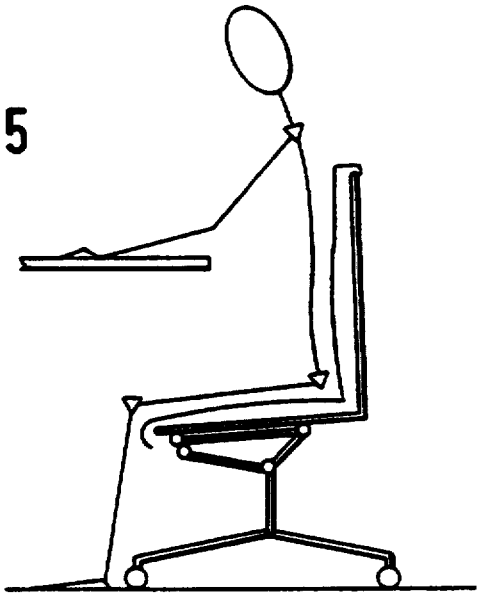
FIG. 5 shows a chair in the writing position (negative inclination: seat surface and back rest inclined forwards)
Figure 6:
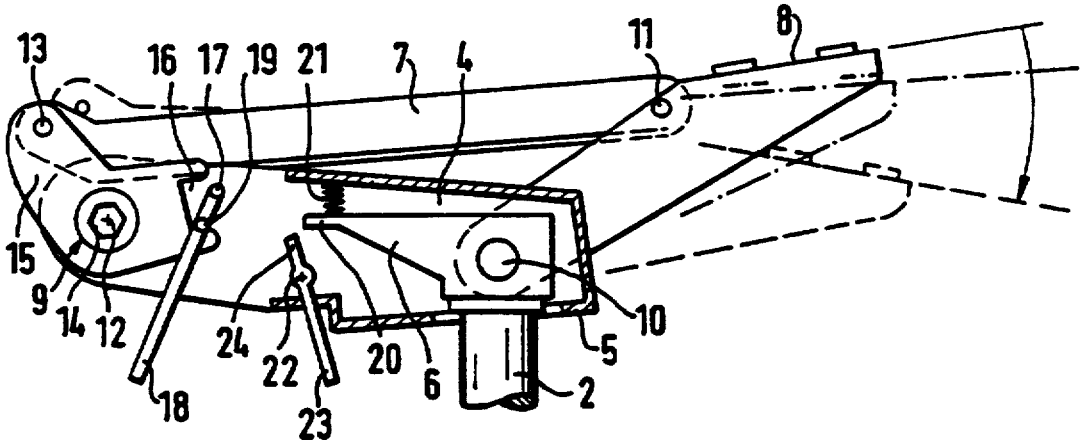
FIG. 6 shows a chair mechanism in the writing position.

FIG. 5 shows the chair in the negative inclination. The person sitting on it has a forwardly curved posture, such as for writing, for example. FIG. 6 shows the corresponding configuration of the chair mechanism 1. The seat cushion on the seat carrier 7 is slightly inclined forwards, and the back rest likewise inclines forwards. The illustration relates to the front end position of the negative inclination. However, all intermediate positions, depending on the loading through the weight displacement, can be achieved steplessly.

In this position, as is also the case in FIGS. 3 and 4, the synchronous mechanism is not actuated. In this respect the description given previously is similarly applicable. The writing posture of the user changes the weight distribution in the sense that an increased pressure is exerted on the front part of the seat surface and acts against the compression springs 21 to bring about a more or less extensive forward swivelling, extending as far as a stop, of the chair mechanism 1 about the negative inclination pivot axis 10, depending on the extent of the weight displacement.

In the maximum negative inclination the compression springs 21 are compressed to the maximum and the distance—in the region of the springs—between the tongue portion 20 and the inclined arm, lying thereabove, of the movable support part 5 is reduced to a minimum. The opposite is true of the distance between the tongue portion 20 and the offset arm, lying therebeneath, of the movable seat support part 5. This distance has increased to its maximum, so that the locking lever 23 could be swivelled in, with its locking beak 24 under the tongue portion 20 (see in this regard the explanation relating to FIGS. 10 and 11).

If the user now straightens himself up, the change of load brings about a sliding reversal of the negative inclination; and if he leans backwards, a stepless transition to the relaxing position is achieved.

Figure 7:
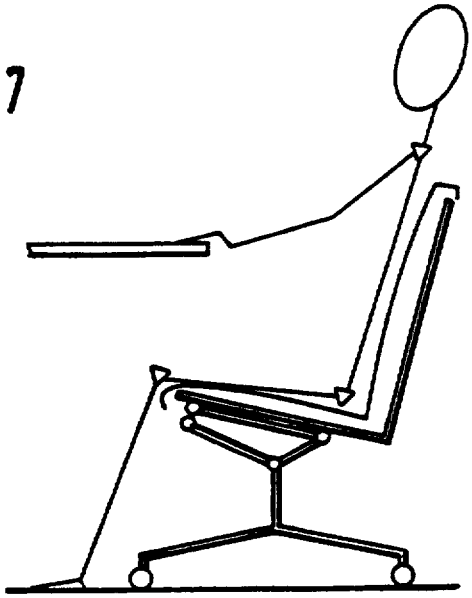
FIG. 7 shows a chair in the relaxing position (seat surface and back rest inclined backwards)
Figure 8:
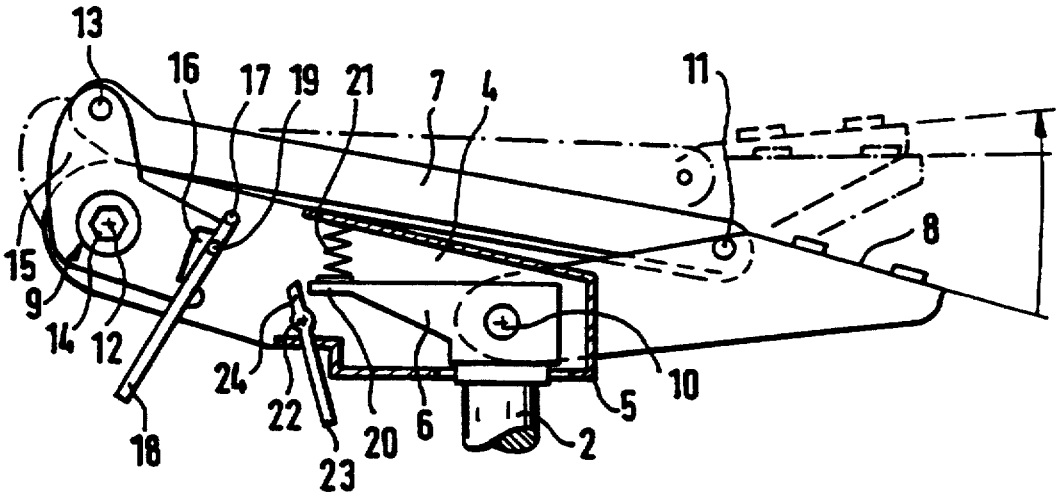
FIG. 8 shows a chair mechanism in the relaxing position.

FIG. 7 shows the chair in the relaxing position. The person sitting on it has assumed a rearwardly inclined posture, such as for example for a lengthy telephone conversation. FIG. 8 shows the corresponding configuration of the chair mechanism 1. The seat cushion on the seat carrier 7 is minimally raised at the front, but at the rear is more markedly lowered. The back rest is also backwardly inclined in the same direction. The drawing illustrates the rear end position for the relaxing posture. Here again all intermediate positions can also be obtained steplessly, depending on the pressure against the back rest resulting from the weight displacement.

In this position the negative inclination is of no consequence. Since no correspondingly increased pressure is exerted on the front part of the seat surface, the negative inclination is set to the "O" value through the action of the compression springs 21, that is to say the chair mechanism 1 is not swivelled about the negative inclination pivot axis 10. Since the locking lever 23 for the negative inclination can be swivelled in only at maximum negative inclination, its locking action is obviously entirely out of the question here.

In the relaxing position the synchronous mechanism is in action. Adequate pressure exerted by the user against the back rest brings about the rearward swivelling of the latter and the lowering of the back rest carrier 8 about the negative inclination pivot axis 10, on which the back rest carrier 8 is also pivoted. At the same time the seat carrier 7, which is pivoted on the pivot axis 11 for the seat and back rest carriers, is pulled downwards and further to the rear. This in turn has the consequence that, because of the articulated connection between the seat carrier 7 and the driver plates 15, on the front seat pivot axis 13, the driver plates 15 are swivelled about the main pivot axis 12 for the synchronous movement and, as it were, pulled. Since however the driver plates 15 on the one hand are fastened (for example by welding) to the front seat pivot axis 13 and on the other hand are in engagement with the torsion bar 14, the increasing rearward swivelling of the back rest proceeds against the spring force which increases with the angle of twist of the torsion bar 14. The swivelling range of the back rest within the synchronous movement is limited by two stops for example the catch lever pin 19 against the top and bottom lugs of the recesses 16 in the plates.

If the user straightens himself up from a rear relaxing position—the pressure against the back rest is reduced or completely eliminated—the torsion spring 19 pulls the back rest into an increasingly vertical position, and the seat surface is aligned horizontally in harmony, in the same direction. If the user bends further forward, there will be a sliding transition from the synchronous movement to the negative inclination.

Figure 9:
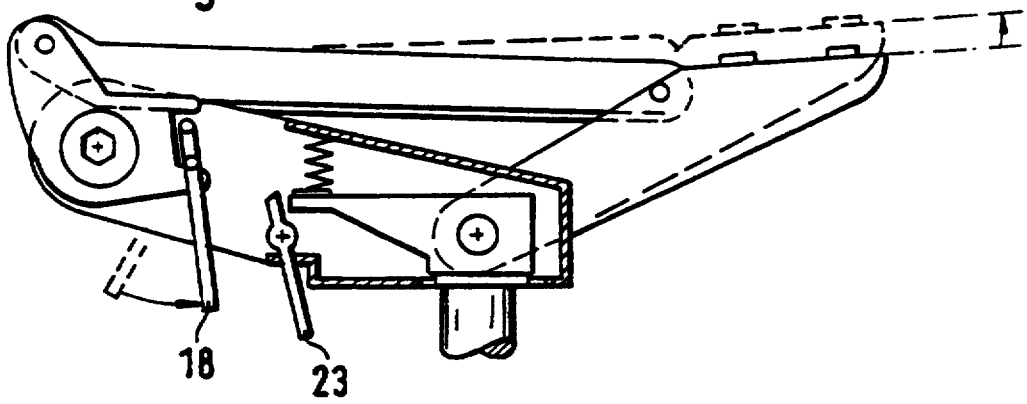
FIG. 9 shows the option in which the synchronous mechanism is locked.

For special cases options are provided on the chair mechanism 1. FIG. 9 shows the catch lever 18 swivelled into engagement from the "open" position, so that the synchronous movement is blocked and the chair mechanism 1 is in the normal position. Swivelling out of this position into the negative inclination is possible. The option in which the synchronous movement is blocked is useful for example for people who have back problems, for whom rearward inclining must be avoided.

Figure 10:
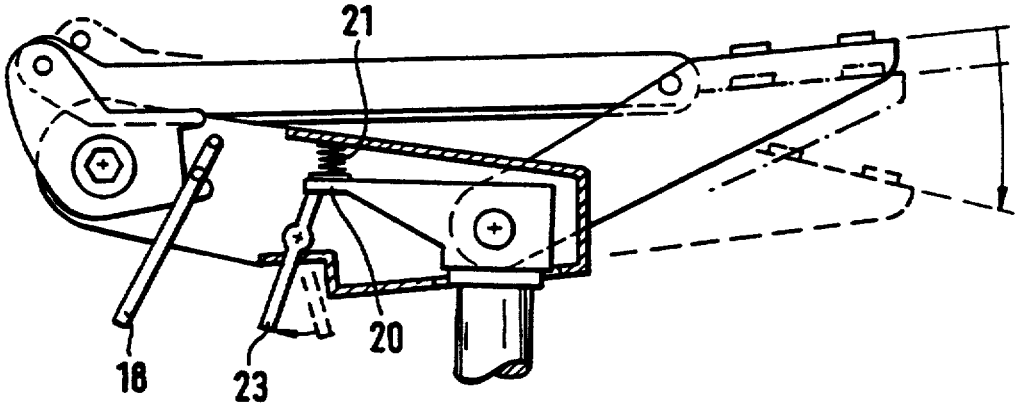
FIG. 10 shows the option in which the negative inclination is locked.

FIG. 10 illustrates the option enabling the maximum negative inclination assumed to be locked by means of the locking lever 23, which is swivelled into engagement under the tongue portion 20. The entire adjustment range of the synchronous movement can be passed through from the locked negative inclination. This range is simply shifted forwards to the extent of the negative inclination angle, and correspondingly the rear end position of the relaxing posture is brought forward by this amount. The option permitting the locking of the chair in the negative inclination will be useful for persons of very light weight, who would always have to make a certain effort to press the seat surface downwards at the front against the force of the compression spring 21.

Figure 11:
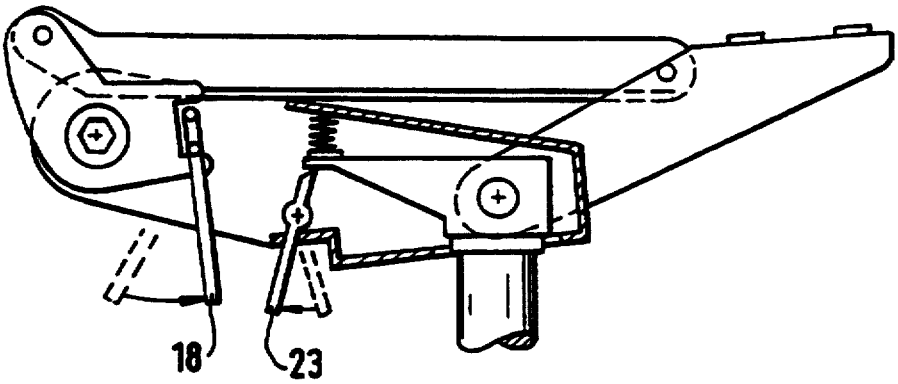
FIG. 11 shows the option in which the synchronous mechanism and the negative inclination are locked.

For quite specific applications provision is finally made, as shown in FIG. 11, for both the synchronous movement and the negative inclination to be blocked, respectively by swivelling in the catch lever 18 and by swivelling in the locking lever 23.

The above-described synchronous mechanism with integrated negative inclination combines all positive knowledge, previously used separately, in order to reduce to a substantial extent the negative, detrimental influences of continuous sitting. With the chair mechanism proposed it will be possible to make provision, in accordance with modern medical and ergonomic requirements, for all sitting postures occuring during office work. The creation of a chair mechanism having a movement range from negative inclination to a rear relaxing position simply through weight displacement due to the posture of the user's upper body—without supporting the arms or raising the buttocks—was in the final analysis possible only as the result of inventive and completely new conceptual treatment and constructive application of loading and movement cycles during sitting.

On a chair equipped in this manner the user's pelvis is set forward in the writing posture because of the forward, negative inclination of the seat surface, so that the user automatically stops curving his back and assumes the unobjectionable "rider posture". The chair permits normal upright sitting and finally the relaxing phase when leaning back, and the chair adapts itself continuously and harmoniously to the loading posture.

Among other factors, the arrangement, function and connection of the pivot axes and the configuration of the seat support are of decisive importance.

I claim:

1. A work chair mechanism providing for a swivelling range with stepless transition from a forwardly inclined position to a rearwardly inclined position based on the sitting posture and distribution of a user's body, said mechanism comprising:

a seat carrier (7) pivoted at a front portion about a front pivot axis (13) and a rear portion about a rear pivot axis (11);

a back rest carrier (8) in connection with the seat carrier about said rear pivot axis; and a plurality of driver plates (15) forming a recess (16) in which a stop is provided for limiting the swivelling range of the chair, the driver plates connecting said front pivot axis to a main pivot axis (12), the main pivot axis comprising a longitudinal axis of a torsional spring (9), wherein;

the seat carrier, drive plates, torsion spring and back rest carrier are mounted as a system on a resilient seat support (4) and pivotable about a negative inclination pivot axis (10) of the resilient seat support, the negative inclination axis being in line with an upright tube (2) of the chair.

2. Chair mechanism according to claim 1, characterised in that a positioning of the pivot axes, i.e. the negative inclination pivot axis (10), main pivot axis (12), front pivot axis (13), and rear pivot axis (11) for the seat and back rest carriers, along with the dimensioning of the components of the apparatus are formed in such a manner that the chair mechanism (1) reacts over its entire swivelling range to the weight displacement by the upper part of the user's body.

3. Chair mechanism according to claim 1, characterised in that options are provided for the separate locking of a rearwardly inclined position by means of a catch lever (18) and of a forwardly inclined position by means of a locking lever (23).

4. Chair mechanism according to claim 3, characterised in that the locking of the rearwardly inclined position is effected by swivelling the catch lever into the recess (16) formed by the driver plates (15).

5. Chair mechanism according to claim 3, characterised in that the locking of the forwardly inclined position is effected by swivelling in the locking lever (23) against a fixed seat support part (6).

6. Chair mechanism according to claim 1, characterised in that the seat support (4) comprises a fixed seat support part (6), which is provided with a receiving cone (3) for mounting on the upright tube (2), and a movable seat support part (5), the movable seat support part (5) being spring mounted on the fixed seat support part (6) by means of a compression spring (21).

7. Chair mechanism according to claim 6, characterised in that the movable seat support part (5) of the seat support (4) is resiliently mounted on the negative inclination pivot axis (10).

8. Chair mechanism according to claim 7, characterised in that a leaf spring is used to bias the seat support (4).

* * * * *